US006475118B1

(12) United States Patent
Nichols-Ketchum

(10) Patent No.: US 6,475,118 B1
(45) Date of Patent: Nov. 5, 2002

(54) GYMNASTICS BAR AND METHOD OF MAKING THE SAME

(75) Inventor: Martha Nichols-Ketchum, Jefferson, IA (US)

(73) Assignee: American Sports International, Ltd., Jefferson, IA (US)

( * ) Notice: Subject to any disclaimer, the term of this patent is extended or adjusted under 35 U.S.C. 154(b) by 482 days.

(21) Appl. No.: 09/008,872

(22) Filed: Jan. 20, 1998

(51) Int. Cl.[7] ..... A63B 1/00
(52) U.S. Cl. ..... 482/38; 482/34
(58) Field of Search ..... 482/23, 24, 34, 482/37–42; 72/53

(56) References Cited

U.S. PATENT DOCUMENTS

| | | | | | |
|---|---|---|---|---|---|
| 254,215 | A | * | 2/1882 | Heeseler | 482/38 |
| 3,207,511 | A | * | 9/1965 | Hoffman | 482/42 |
| 3,524,644 | A | * | 8/1970 | Kane | 482/38 |
| 5,179,237 | A | * | 1/1993 | Grossman | 84/422.4 |

FOREIGN PATENT DOCUMENTS

| | | | | |
|---|---|---|---|---|
| JP | 6-271930 | * | 9/1994 | 72/53 |

OTHER PUBLICATIONS

Nissen, Gymnasium Equipment 1975 Catalog, The Horizontal Bar, pp. 18–20, 1975.*
Metal Improvement Company, Inc. "Shot Peening Applications", Seventh Edition, pp. 1–83, Paramus, New Jersey.

* cited by examiner

*Primary Examiner*—Glenn E. Richman
*Assistant Examiner*—Victor Hwang

(57) ABSTRACT

A gymnastic bar has a textured non-smooth surface throughout its length to enhance its strength and to facilitate the gripping thereof by gymnasts. The texture of the bar is created by subjecting the bar to a shot peening process wherein the bar is subject to being impacted by a plurality of high velocity, hard particulate material to create indentations in the surface thereof throughout the substantial area of the surface. The bar, of stainless steel material, is heat treated before being subjected to the peening process. The bar is subjected to the process until it achieves a tensile strength of approximately 190,000 p.s.i.

6 Claims, 2 Drawing Sheets

GYMNASTICS BAR AND METHOD OF MAKING THE SAME

BACKGROUND OF THE INVENTION

Gymnastic bars, such as a horizontal bar, present at least two serious areas of consideration in construction and use that create some degree of deficiency. The first is that the construction of the bar must be absolutely perfect to assure that breakage will not occur even over long periods of usage so that the gymnast will not be injured while performing. While injury because of breakage happens infrequently, the possibility thereof does increase as the use and age of the bar increases.

Existing bars are smooth and gripping the bars for performance purposes is a universal problem. Performers will typically wear gloves treated with rosin or the like to facilitate and enhance the gripping action.

Accordingly, it is a principal object of this invention to provide a gymnastic bar and method of making the same that will greatly enhance the strength thereof and facilitate its being grasped by gymnasts.

This and other objects will be apparent to those skilled in the art.

SUMMARY OF THE INVENTION

The gymnastic bar of this invention has a textured non-smooth surface throughout its length to enhance its strength and to facilitate the gripping thereof by gymnasts. The texture of the bar is created by subjecting the bar to a shot peening process wherein the bar is subject to being impacted by a plurality of high velocity, hard particulate material to create indentations in the surface thereof throughout the substantial area of the surface. The bar, of stainless steel material, is heat treated before being subjected to the peening process. The bar is subjected to the process until it achieves a tensile strength of approximately 190,000 p.s.i.

DESCRIPTION OF THE PREFERRED EMBODIMENT

Figure 3:
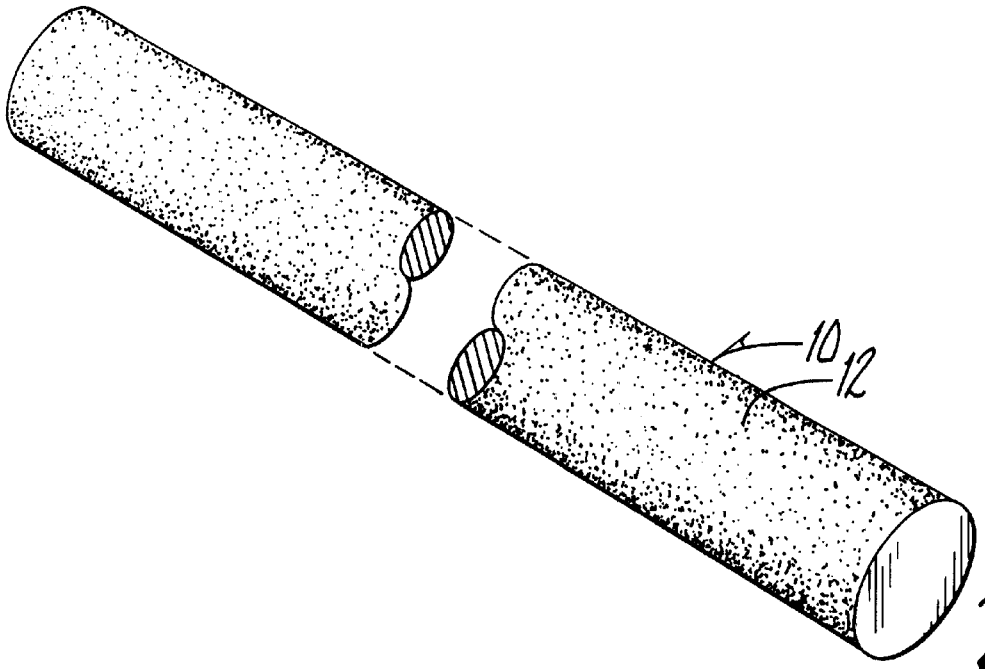
FIG. 3 is a perspective view of the bar of this invention.

The horizontal bar 10 of FIG. 3 is 96 inches long and 1.102 inches (28 mm) in diameter (plus or minus 0.0039 inches). In use, it is held in an elevated position for the gymnasts to perform upon. The bar 10 is of stainless steel material (Type AL-630-17 CR4 N.I. P.H)

The bar 10 is initially finished ground, and then heat treated according to the following specifications: H900 CG Finish (Rms 63 Max)(ground) and Bar Sol anneal 1900° F., oil quenched or air cooled, and aged 1 hour at 900° air cooled (heat treated).

Shot peening is a known process for treating and enhancing the strength of metal, but has not been applied to athletic equipment to enhance strength and grasping. Shot peening is a process of subjecting the surface of an object to a shower of high velocity hard particles which will impact and indent the surface area. Coverage of the shot peening process refers to the population of peening dimples on a surface as verified by coverage inspection techniques. Saturation time is determined on an Almen strip of hardness HRC44–50. If the part being peened is much softer than the Almen strip, it will cover in a shorter period of time. Conversely, if the part being peened is much harder than the Almen strip, it will require a correspondingly longer exposure time to the shot stream, because the dimples on the harder surface will be smaller.

Figure 1:
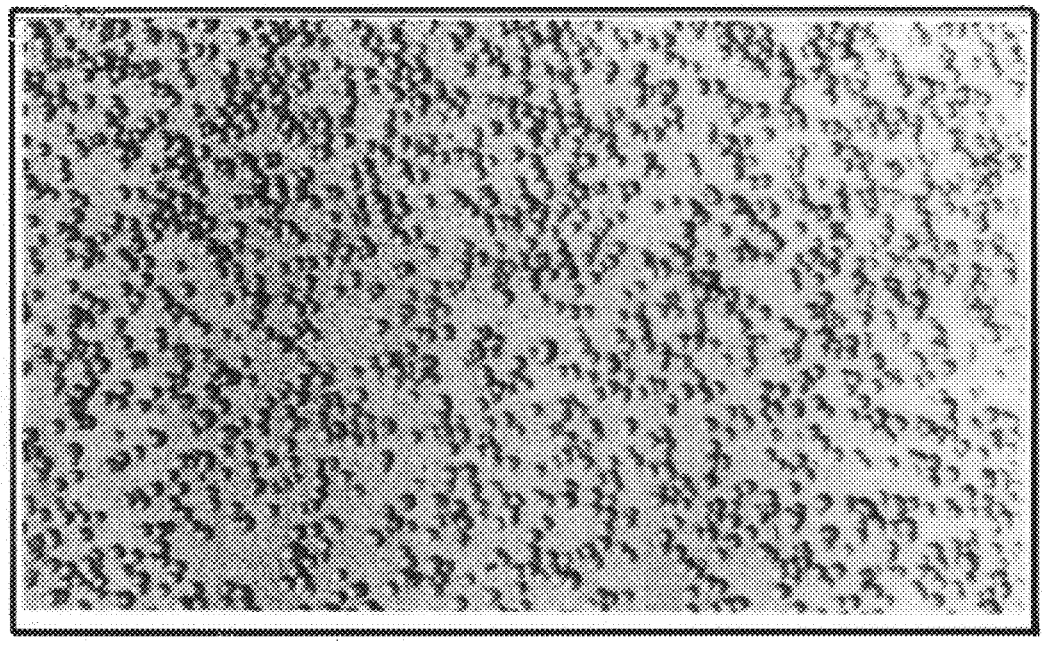
FIG. 1 is a photograph showing the texture of the bar is partially covered by the peening process.
Figure 2:
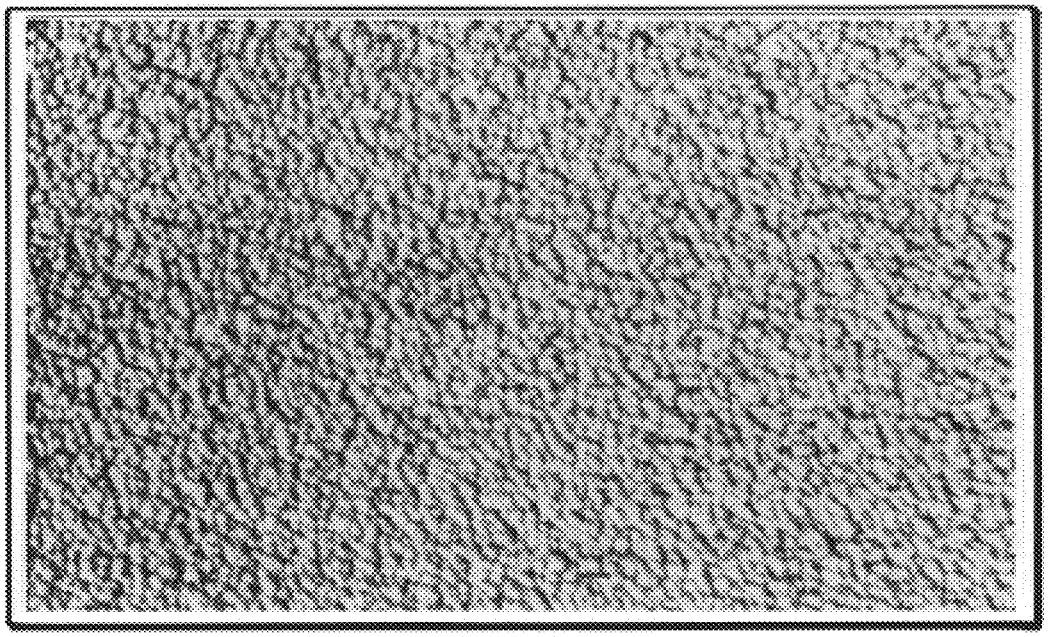
FIG. 2 is a photograph showing the texture of the bar is 100% covered by the peening process.

Coverage is defined as the extent (in percent) of uniform and complete dimpling or obliteration of the original surface of the part or workpiece. Inspection of percent coverage can be accomplished using a ten power (10×) magnifying glass or the PEENSCAN® Process. FIGS. 1 and 2 show photographs of partial and full coverage on bar 10. 100% coverage is reached when the original surface of the material is obliterated entirely by overlapping peening dimples. Coverages (in percent) above 100% are simply multiples of the exposure time necessary to achieve 100% coverage. Thus, 150% coverage would be achieved by exposing the part 1.5 times the time required to achieve 100% coverage. One-hundred to 200% coverage is preferred for this invention. The process preferably includes using 0.011 inch diameter cast steel shot (55–65 Rockwell C Hardness) with an impact intensity of 0.008–0.012A, which is the measure of intensity on the Almen strip.

The PEENSCAN® process, referenced by the U.S.A. Military Specification, Mil-S-13165-B Amendment 2, Paragraph 6.10, is used to measure uniformity and extent of coverage on a shot peened part. Overlapping dimples must completely obliterate surface discontinuities for proper 100% coverage.

DYESCAN® fluorescent tracer liquids, used in the PEENSCAN® process, are brushed, sprayed or dipped on to a part and allowed to dry. This forms a fluorescent elastic coating, which is removed at a rate proportional to the percentage of shot peening coverage. Examination under UV (black) light, the PEENSCAN® process provides a practical method of determining peening coverage in terms of the amount and uniformity of fluorescent tracer removal. The PEENSCAN® process has been found to be clearly superior to inspection using a 10X glass for determination of peening coverage.

It is preferred that bar 10, after being heat treated, be subjected to shot peening for at least 100% coverage which will result in a tensile strength of at least 190,000 p.s.i. The resulting texture 12 of the bar will greatly enhance the hand gripping ability of the gymnast.

The completed bar 10 will be virtually indestructible and will provide a gripping surface 12 that will diminish if not eliminate existing grip-enhancing gloves or materials that gymnasts presently use.

It is therefore seen that this invention will achieve at least all of its stated objectives.

What is claimed is:

1. An elongated gymnastic bar to be supported in an elevated position for gymnasts to grasp by their hands at times while moving over and around said bar, comprising, an elongated solid metal bar having a textured non-smooth surface throughout its length to add to the strength thereof and to facilitate the gripping thereof by the gymnasts wherein the textured non-smooth surface is created by subjecting the bar to a shot peening process wherein the bar is impacted by a plurality of hard particulate material to create indentions in said surface throughout 100 percent of said surface the bar being heat treated before texturing, the bar having a final tensile strength of at least 190,000 psi.

2. The bar of claim 1 wherein said bar is comprised of stainless steel.

3. The bar of claim 1 wherein said bar is approximately 1.102" in diameter.

4. A method of making an elongated gymnastic bar to be supported in an elevated position for gymnasts to grasp by their hands at times while moving over and around said bar, comprising, taking an elongated solid metal bar having an outer cylindrical surface creating a textured non-smooth surface on said cylindrical surface of said bar by subjecting the bar to a shot peening process wherein the bar is impacted by a plurality of hard particulate material to create indentions in 100 percent of said surface, heat treating the bar before subjecting the bar to the shot peening process, wherein the bar will have a final tensile strength of at least 190,000 psi.

5. The method of claim 4 wherein said bar is heat treated before being subjected to said shot peening process by being heated to a temperature of at least 1900° F.

6. The method of claim 4 wherein said bar is stainless steel.

* * * * *